US008545181B2

(12) United States Patent
Charlton

(10) Patent No.: US 8,545,181 B2
(45) Date of Patent: Oct. 1, 2013

(54) TURBINE BLADE ASSEMBLY

(75) Inventor: Scott Charlton, Newark (GB)

(73) Assignee: Siemens Aktiengesellschaft, München (DE)

( * ) Notice: Subject to any disclaimer, the term of this patent is extended or adjusted under 35 U.S.C. 154(b) by 1175 days.

(21) Appl. No.: 12/311,837

(22) PCT Filed: Aug. 31, 2007

(86) PCT No.: PCT/EP2007/059084

§ 371 (c)(1),
(2), (4) Date: Apr. 14, 2009

(87) PCT Pub. No.: WO2008/046684

PCT Pub. Date: Apr. 24, 2008

(65) Prior Publication Data

US 2010/0178173 A1 Jul. 15, 2010

(30) Foreign Application Priority Data

Oct. 17, 2006 (EP) ..... 06021770

(51) Int. Cl.
*B63H 1/16* (2006.01)

(52) U.S. Cl.
USPC ..... 416/193 A; 416/221; 416/248

(58) Field of Classification Search
USPC ..... 416/248, 96 R, 193 A, 190, 191, 416/221; 29/889, 21
See application file for complete search history.

(56) References Cited

U.S. PATENT DOCUMENTS

| | | | | |
|---|---|---|---|---|
| 3,295,825 | A | 1/1967 | Hall, Jr. | |
| 3,801,220 | A * | 4/1974 | Beckershoff | 416/198 R |
| 4,265,594 | A | 5/1981 | Eggmann | |
| 4,872,810 | A * | 10/1989 | Brown et al. | 416/145 |
| 6,561,764 | B1 * | 5/2003 | Tiemann | 416/96 R |
| 2005/0186074 | A1 | 8/2005 | Tomita et al. | |
| 2009/0004013 | A1 * | 1/2009 | Ramlogan et al. | 416/190 |

FOREIGN PATENT DOCUMENTS

| | | | |
|---|---|---|---|
| CH | 525419 | A | 7/1972 |
| DE | 102004016174 | A1 | 10/2005 |
| EP | 1 600 606 | A1 | 11/2005 |
| GB | 1 580 884 | | 12/1980 |
| GB | 2182399 | A | 5/1987 |
| GB | 2 280 935 | A | 2/1995 |
| GB | 2 303 888 | A | 3/1997 |
| GB | 2400144 | A1 | 10/2004 |
| JP | 10184310 | A | 7/1998 |
| RU | 2159856 | C2 | 6/1996 |
| WO | WO 0057031 | A1 | 9/2000 |
| WO | WO 2004/074640 | A1 | 9/2004 |

* cited by examiner

*Primary Examiner* — Nitin Parekh

(57) ABSTRACT

A turbine blade assembly, which can be used for a gas turbine is provided. The turbine blade assembly includes turbine blades with platforms, gaps between the platforms of adjacent turbine blades and seals. Each seal covers the gap between the platforms of two adjacent turbine blades wherein the platforms are provided with slots extending in the downstream flow direction. The turbine blades have root cavities, wherein the seal covers at least the whole length of the root cavities of two adjacent turbine blades. The seal is formed from a strip and the seal is placed in two opposed slots formed in each of the platforms of two adjacent turbine blades and open towards the respective downstream ends.

10 Claims, 2 Drawing Sheets

TURBINE BLADE ASSEMBLY

CROSS REFERENCE TO RELATED APPLICATIONS

This application is the US National Stage of International Application No. PCT/EP2007/059084, filed Aug. 31, 2007 and claims the benefit thereof. The International Application claims the benefits of European Patent Office application No. 06021770.0 EP filed Oct. 17, 2006, both of the applications are incorporated by reference herein in their entirety.

BACKGROUND OF THE INVENTION

The invention relates to a turbine blade assembly, in particular for a gas turbine and a method for assembling a turbine blade assembly.

Seal strips are used between adjacent turbine blades to prevent the ingress of hot gasses into a root cavity which can cause undesired heating of the disc rim and loss of efficiency. Where blades are assembled into the disc as a full ring (for interlocked designs or where differential platform/root and shroud skew angles are in evidence) seal strips cannot be introduced using the conventional sequential build methodology. More so a method must be devised to permit assembly and retention of the strips with the bladed disc complete.

Generally assemblies have been built up using sequential build techniques where single blades and strips are assembled to complete the full ring. Where blades are fitted as full sets then full length platform seal strips have not been utilised. In previous cases small seal plates have been fitted in upstream seal slots and retained using locking strips. This does not provide adequate coverage across the platform length in addition that seal strips are not used in high pressure turbine disc assemblies as locking plates are required for both blade retention and to prevent cross leakage of cooling air. This state of the art does not provide an adequate measure for preventing ingress of hot gas into the root cavities of the turbine blades.

EP 1 600 606 A1 discloses an arrangement of turbine blades with gaps between the platforms of adjacent turbine blades. These gaps are closed by sealing and damping elements in the form of strips. The sealing and damping strips are held in place by centrifugal forces.

Document U.S. Pat. No. 4,265,594 discloses a turbine blade arrangement with turbine blades having platforms with segments and cover plates extending in the longitudinal direction of the rotor axis. The gaps between the cover plates are provided with slots in which sealing strips are inserted.

Sealing arrangements for turbine vanes are described in GB 2 280 935 A, GB 1 580 884, WO 2004/074640 A1, GB 2 303 888 A, GB 2 182 399 A and JP 10184310 A.

OBJECTIVE OF THE INVENTION

The objective of the invention is to provide an improved turbine blade assembly with a seal strip. Another objective is to provide a gas turbine with an improved turbine blade assembly comprising a seal strip. A third objective of the invention is to provide an improved method for assembling a turbine blade assembly with a seal strip.

SOLUTION ACCORDING TO THE INVENTION

These objectives are solved by a turbine blade assembly, by a gas turbine and by a method for assembling a turbine blade assembly according to the claims. The depending claims contain further developments of the invention.

An inventive turbine blade assembly comprises turbine blades with platforms and gaps between the platforms of adjacent turbine blades. It further comprises seals. Each seal covers the gap between the platforms of two adjacent turbine blades. The platforms are provided with slots in circumferential sides facing adjacent turbine blades, and the turbine blades comprise root cavities, wherein the seal covers at least the whole length of the root cavities of two adjacent turbine blades. The seal is formed from a strip and is placed in two opposed slots formed in each of the platforms of two adjacent turbine blades, and being open towards their downstream ends.

This arrangement provides a sealing between adjacent turbine blades. The seal prevents the ingress of hot gases into the root cavity which can cause undesired heating of the disc rim and loss of efficiency. The form of the strip ensures full cavity sealing results across the length of the platform and prevents the ingress of hot gases. The seal strips are placed in opposed slots formed in each of the platforms of two adjacent turbine blades. This allows for precise positioning of the seal strips.

In an advantageous development the seal is made of a flexible, resilient material. The material permits the strips to be inserted into the slots from the open downstream end using a continuous motion.

In another advantageous development of the invention the seal is locked in the blades by locking plates which are assembled at the downstream end of the turbine disc. The locking plates are used for both blade retention and to prevent cross leakage of cooling air.

The seal is retained in a slot cavity at the upstream end with an appropriate gap to allow for transient thermal growths—this ensures no forced damping of the blade during operation.

Advantageously a gas turbine may be equipped with a turbine blade assembly according to the present invention. The gas turbine will have a reduced loss of cooling air and heating of the turbine disc rim.

The invention further comprises a method for assembling a turbine blade assembly, in particular for a gas turbine, wherein turbine blades are assembled to a turbine disc and seals are assembled to platforms of platform blades to cover gaps between the platforms of adjacent turbine blades. All the turbine blades are fitted to the turbine disc before the seals are fitted between the platforms of adjacent turbine blades. The form of the strips and the method of retention permits the strips to be fitted to a bladed disc assembly where all the blades have previously been fitted.

The seals can be fitted from the downstream bladed disc face. This allows for an easier assembly and disassembly.

The seals may be inserted into opposing slots in adjacent platforms by continuous motion permitting an easy assembly.

Further features, characteristics and advantages of the invention become clear from the following description of the embodiments in reference to the accompanying drawings.

DETAILED DESCRIPTION OF THE EMBODIMENT

Figure 1:
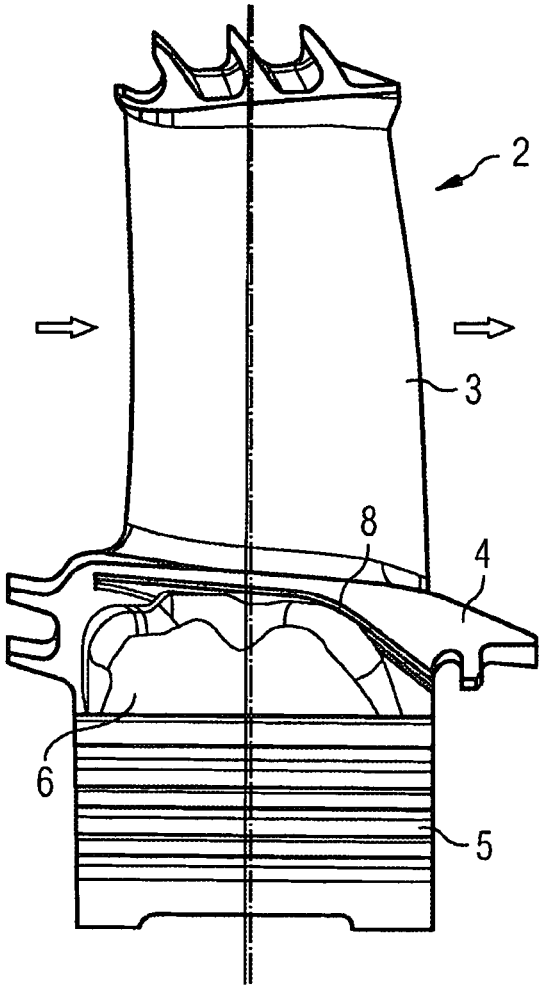
FIG. 1 shows a turbine blade with a slot.

FIG. 1 shows a side view of a turbine blade 2 with a airfoil 3, a platform 4, a blade root 5, a root cavity 6 and a slot 8.

The platform 4 is placed at the bottom of the airfoil 3 and covers the root cavity 6 that is formed between the blade root 5 and the platform 4. A slot 8 is integrated into each side of the platform 4 running along the top of the root cavity 6. When assembled to a turbine disc 12 two slots 8 of two adjacent turbine blades 2 are in an opposed position to hold a seal strip 10 from two sides. The slots 8 are closed towards the upstream end for retention and open towards the downstream end of the turbine blade 2 for insertion. Each two opposed slots 8 are provided as guides and retentions of a seal strip 10.

The turbine blade 2 is used in a gas turbine where hot pressurized gas is guided towards turbine blades with airfoils that are fixed on a rotor to move the turbine blades and thus drive the rotor to which the turbine blades are assembled in a circumferential direction. Due to the contact of the turbine blades with the hot gas a cooling of the turbine blades is required. Cooling air is guided through the blade roots 5 of the turbine blades 2 into the airfoils 3.

Figure 2:
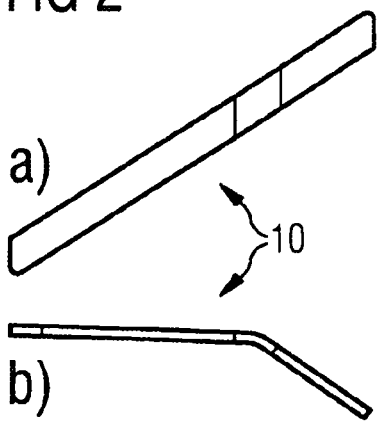
FIG. 2 shows a seal strip.

FIG. 2 shows a seal strip 10 according to the invention. The seal strip 10 is a stretched rectangular shaped, skewed in line with the blade roots with rounded corners for better insertion. It is made of a flexible, resilient material for better assembly and disassembly. The seal strip 10 preformed as per FIG. 2*b* prior to insertion, this enables fitting using a continuous action from the downstream face of the turbine blade 2 into the slot 8.

Figure 3:
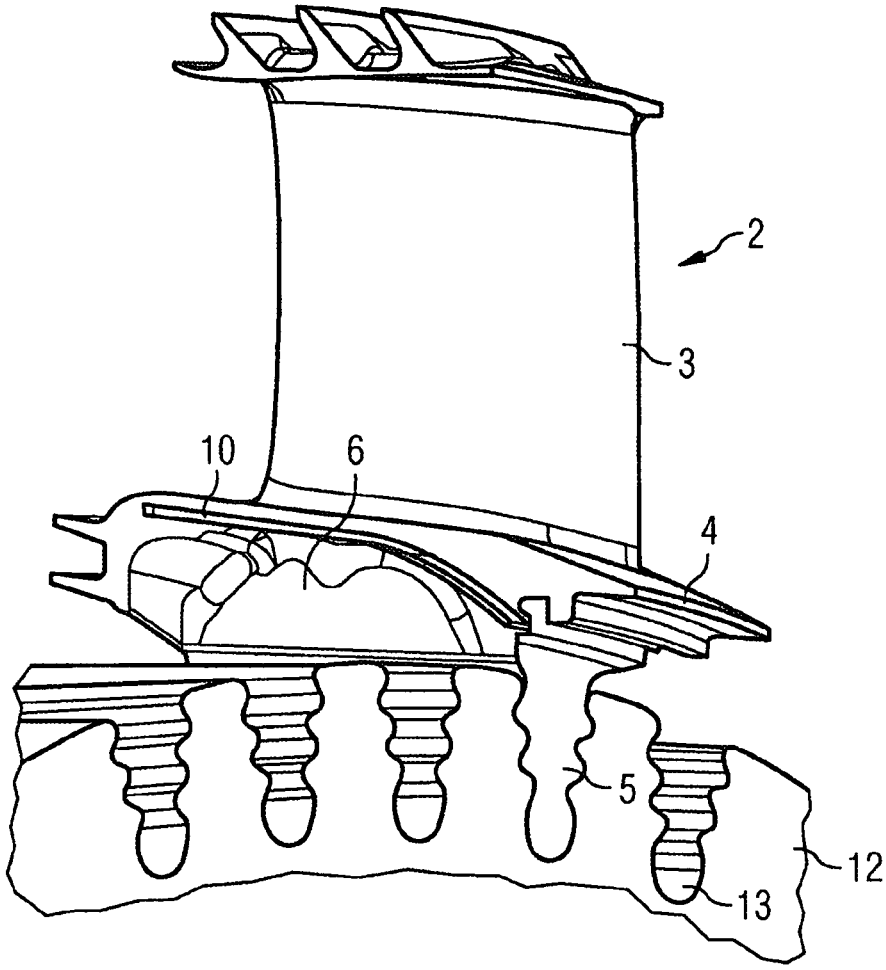
FIG. 3 shows a turbine blade with an inserted seal strip.

FIG. 3 shows a turbine blade 2 as shown in FIG. 1 mounted to a turbine disc 12 by insertion of its blade root 5 into an axial groove 13 of the turbine disc 12. The axial grooves 13 run along the circumference of the turbine disc 12. The axial grooves 13 are formed to hold the roots 5 of the turbine blades 2. Several turbine discs 12 form the rotor of the gas turbine (not shown). After the turbine blades 2 are assembled to the turbine disc 12 to form a full ring seal strips 10 are fitted in the opposed slots 8 of adjacent turbine blades 2 from their downstream end by a continuous motion.

In operation of the gas turbine, hot gas passes the airfoil 3 of the turbine blade 2 causing a rotation of the turbine blade 2. Cooling air is passed through the blade root 5 into the airfoil 3 to cool the turbine blade 2. The seal 10 keeps cooling air under the platforms 4 of adjacent turbine blades 2 and prevents hot gas from flowing into the root cavity 6 of the turbine blade 2. This prevents overheating of disc rim 12 ensuring safe turbine operation.

The seal strip 10 is made of a flexible, resilient material so that it is held in the slot 8 by its resilient force. It is also retained in the slot 8 by a force fit in the upstream end of the slot 8. The seal 10 is inserted from the downstream end of the slot 8.

Each stage of the turbine is assembled by fitting turbine blades 2 to a turbine disc 12 to complete a full ring. After that the seal strips 10 are fitted in the opposed slots 8 of adjacent turbine blades 2 from their downstream end by a continuous motion.

The invention claimed is:

1. A turbine blade assembly, comprising:
a turbine disc,
two adjacent turbine blades mounted on the turbine disc, each turbine blade comprising:
a platform,
a root cavity, and
a slot facing the two adjacent turbine blades;
a gap between the two platforms of the two adjacent turbine blades; and
a seal,
wherein each platform is provided with a slot in a circumferential side facing the two adjacent turbine blades,
wherein the seal covers the gap between the two platforms of the two adjacent turbine blades,
wherein the seal covers at least a whole length of the two root cavities of the two adjacent turbine blades, and
wherein the seal is formed from a strip and the seal is placed in the adjacent facing slots,
wherein the slots are closed towards an upstream end for retention and open at a downstream end of the turbine blades for insertion.

2. The turbine blade assembly as claimed in claim 1, wherein the seal is made of a flexible, resilient material.

3. The turbine blade assembly as claimed in claim 2, wherein the seal is made of a stretched, rectangular shaped material with a plurality of rounded corners.

4. The turbine blade assembly as claimed in claim 1, wherein the seal is locked in the two adjacent turbine blades by a plurality of locking plates which are assembled at the downstream end of a turbine disc.

5. The turbine blade assembly as claimed in claim 1, wherein the seal is inserted into and guided by the two opposing slots in the two adjacent platforms by a continuous motion.

6. A gas turbine comprising:
a turbine blade assembly according to claim 1.

7. The gas turbine as claimed in claim 6, wherein the seal is made of a flexible, resilient material.

8. The gas turbine as claimed in claim 7, wherein the seal is made of a stretched, rectangular shaped material with a plurality of rounded corners.

9. The gas turbine as claimed in claim 6, wherein the seal is locked in the two adjacent turbine blades by a plurality of locking plates which are assembled at the downstream end of a turbine disc.

10. The gas turbine as claimed in claim 6, wherein the seal is inserted into and guided by the two opposing slots in the two adjacent platforms by a continuous motion.

* * * * *